US005178120A

United States Patent [19]

Howson et al.

[11] Patent Number: 5,178,120

[45] Date of Patent: Jan. 12, 1993

[54] DIRECT CURRENT IGNITION SYSTEM

[75] Inventors: Peter Howson, Brighton, England; Didier De Wit, Wavre, Belgium

[73] Assignee: Cooper Industries, Inc., Houston, Tex.

[21] Appl. No.: 722,783

[22] Filed: Jun. 28, 1991

[30] Foreign Application Priority Data

Jun. 29, 1990 [GB] United Kingdom ..... 9014556

[51] Int. Cl.[5] ..... F02P 3/06

[52] U.S. Cl. ..... 123/605; 123/596; 315/209 CD

[58] Field of Search ..... 123/605, 596, 620, 656; 315/209 CD; 361/253

[56] References Cited

U.S. PATENT DOCUMENTS

| | | | |
|---|---|---|---|
| 4,886,036 | 12/1989 | Johansson et al. | 123/596 |
| 4,967,718 | 11/1990 | Scarnera | 123/605 |
| 5,049,786 | 9/1991 | Gotisar et al. | 315/209 CD |
| 5,060,623 | 10/1991 | McCoy | 123/605 |

*Primary Examiner*—Raymond A. Nelli

*Attorney, Agent, or Firm*—Eddie E. Scott; Alan R. Thiele; Jackie Lee Duke

[57] ABSTRACT

This invention discloses a system for initiating and enhancing combustion of fuel and fuel-air mixtures by discharging electrical energy in a spark gap. The energy to breakdown the spark gap is supplied by a high voltage direct current source which supplies a voltage high enough to cause initiation of the spark without the need for an intermediate transformer. Control of the high voltage is by way of a semiconductor switch, which is preferably a bulk photoconductive switch. Such a switch is capable of withstanding the high voltage applied across it when it is switched off. There may also be provided a further source of high voltage which supplies energy to the spark gap at a lower voltage then the first source after the spark has been initiated. Thus the length of time the spark lasts for may be controlled. This is particularly useful for use with lean fuel mixtures for fuel economy or with diluted fuel mixtures diluted through exhaust gas recirculation for reduced emissions.

6 Claims, 9 Drawing Sheets

DIRECT CURRENT IGNITION SYSTEM

BACKGROUND

The present invention relates to systems for initiating and enhancing combustion of fuel and fuel-air mixtures and deals more particularly with a system for increasing the efficiency with which the electrical discharge energy is coupled into the fuel by ignition enhancement devices.

Initiation of fuel combustion for compression-type internal combustion engines is a well developed art which has its origin in the Otto-cycle Spark Ignition engine that was developed in the late 1800's.

The first ignition systems employed a high voltage magneto that provided the electrical energy to the spark plug according to the position of the engine.

The magneto was gradually replaced during the 1920's by a battery-based induction coil system (Coil Ignition system - C.I. or Kettering system). In these systems, before ignition, the low voltage electrical energy (typically 12 volts) is first transferred from the battery into the primary winding of the coil through mechanical breaker points and generates a high electromagnetic field in the coil. At ignition point, a cam opens the breakers, modifying the field and generating a voltage (typically 20,000 volts) in the secondary high voltage winding of the coil which is applied to the spark plug such that the spark plug gap breaks over and transfers the energy to the air-fuel mixture.

In the case of typical multi-cylinder engines, a high voltage distributor, made of a rotor and a distributor cap, directs the energy to the appropriate spark plug according to the engine crankshaft position through auxiliary air gaps.

The advent of reliable semiconductor device, some 30 years ago, introduced technology which led to the gradual elimination of performance limitation and maintenance problems associated with the mechanical breaker. Transistor-assisted-contact systems (T.A.C.) were introduced where a transistor device relieves the mechanical breaker points of the burden of carrying high current.

More recently, mechanical breaker points have been entirely replaced by opto-electronic or inductive sensors coupled to electronic timing and driver circuitry that directly control the coil primary winding current (Transistor Coil Ignition system - T.C.I.).

Recently efforts have also been made to eliminate the conventional mechanical rotor system for high voltage ignition pulse distribution, mainly in using multiple coils (one coil per spark plug) or coils with multiple windings associated with high voltage diodes (several spark plugs connected to the same secondary coil winding, plug selection made by using energy polarization).

The availability of high power fast switching devices (Metal Oxide Semiconductor Field Effect Transistors—M.O.S.F.E.T., thyristors, for instance) has given rise during the last decades to a variety of capacitor Discharge Ignition systems (C.D.I.).

In these later systems, in contrast to the Kettering system, the energy is stored from the battery into a medium voltage (about 400 volts) capacitor before ignition (using an inverter that converts the 12 volt battery voltage to the desired level); then, at ignition point, the energy is transferred to the spark plug through a high voltage semiconductor switch and a step-up transformer which provides the 400 to 20,000 volt conversion.

Modern conventional coil ignition systems and capacitor discharge systems (C.I., T.C.A., and C.D.I.) usually deliver between 5 and 100 milliJoules (mJ) of electrical energy per spark pulse at a peak output voltage ranging from 20,000 to 30,000 volts. The more common systems operate in the energy range of 20 to 50 mJ per pulse.

In C.I. and T.C.A. ignition systems, the output voltage (across the spark plug gap) rise time ranges from 60 to 200 microseconds ($\mu$S), due to the electrical characteristics of the ignition coils. The spark duration mainly depends on the physical size of the coil, but typically ranges between 1 and 2 milliseconds (mS).

In contrast to the inherently slower longer lasting output pulse characteristics of the coil ignition systems, C.D.I. systems provide faster rising pulses (typically 1 to 50 $\mu$S) at the expense of shorter overall duration for a similar output pulse energy.

The faster rising pulses of the C.D.I. systems are less susceptible to misfire due to spark plug fouling (gap breakdown voltage not reached as all energy dissipated during the rise of the pulse in the plug insulator deposits).

The faster rising pulses of the C.D.I. systems are less susceptible to misfire due to spark plug fouling (gap breakdown voltage not reached as all energy dissipated during the rise of the pulse in the plug insulator deposits).

The overall duration of a C.D.I. ignition pulse could be increased for better ignitibility in most operating conditions; however, that would be made at the expense higher output pulse energy and reduced spark plug lifetime.

Gaseous electrical discharge typically occurs in three phases as follows:

1) A breakdown phase, usually less than a few tens of nanoseconds, in which current flow increases rapidly as the voltage across the discharge gap falls.

2) A transition to arc discharge of relatively high internal energy content and current density.

3) A glow discharge characterized by lower internal energy and current density.

The overall duration of an ignition system discharge and the relative fraction of total energy dissipated during the breakdown, arc and glow phases are primarily governed by the circuit parameters of the system.

The discharge circuits of conventional coil ignition and transistor coil ignition systems typically have high inductance, low capacitance and relatively high resistance. These high impedance systems couple only a small fraction of the discharge energy into the fuel mixture during the breakdown phase and have the feature of relatively quick transition from breakdown to a long duration low current glow discharge.

Capacitive discharge ignition systems generally deliver a current pulse consisting primarily of the arc phase, due to their low output circuit impedance characteristics.

Recently the establishment of strict exhaust emission standards and a demand for better fuel efficiency have placed additional constraints on engine operation. In response to these demands, recent trends in engine design and operation have been toward promoting a better combustion process and extending stable operation to leaner fuel mixtures.

It has been experimentally established that minimum spark ignition energy requirements correspond to fuel mixtures which are at the stoichiometric ratio. This mixture range corresponds to an air-to-fuel mass ratio of about 14.7:1 (or excess air factor lambda=1). This mixture provides maximum laminar flame velocity and maximum engine power output, and it is the mixture with which engines operated prior to the 1970's.

While engines show proper stable operation and driveability when operating at excess air factor ranging 0.85 to 1.15 with conventional ignition systems and engine design, emissions vary greatly within this range. As shown in FIG. 1, emissions of hydrocarbons (HC) and carbon monoxide (CO) decrease with increasing excess air factor in the range mentioned above but emissions of oxides of nitrogen (NOx) increase.

Due to recent legislation on emission control in several countries including USA, Japan, Switzerland, Austria, Sweden, and Canada which has placed limits on the 3 above exhaust gas constituents (HC,CO and NOx), it has been necessary to reduce emissions for instance by exhaust gas after-treatment (thermal after-burning or catalytic after-burning) as emission levels are exceeded at any air factor within the above mentioned engine operating range. Such legislation is likely to be introduced in most countries and to become more and more stringent.

Most common current exhaust gas after-treatment uses three-way or selective catalyst with excess air factor sensor. Operation efficiency of such after-treatment is shown at FIG. 2. The system works such that at stoichiometric ratio the conversion efficiency of the catalyst is satisfactory for the three emission constituents.

Operation with exhaust gas recirculation (E.G.R.) diluted mixtures can achieve significant reductions in exhaust nitrogen oxides emissions. Increasing E.G.R. tends to lower peak combustion temperature which in turn reduces NOx generation.

Conversely, operation with a diluted mixture is characterized by more difficult ignition and slower laminar flame velocity which eventually leads to cycle-by-cycle (C.B.C.) variations, incomplete combustion and a subsequent increase in unburned hydrocarbon emission.

Promoting better combustion initiation and enhancement reduces C.B.C. variations and permits more dilute fuel mixtures up to a level where NOx could be reduced to a level well below regulation limits and exhaust gas after-treatment could concentrate on CO and HC constituents only and with higher efficiency.

Known ignition enhancement systems usually operate at higher energy levels, ranging from about 60 mJ to several joules per pulse.

Some systems provide a single long lasting glow discharge which yields effective ignition kernel durations from 2 to 10 milliseconds. These systems may use either a larger ignition coil, resulting in undesirable spark plug electrode erosion, or two ignition coils alternately triggered to maintain the discharge, resulting in a highly complex system arrangement. Both systems also suffer from poor combustion initiation performance (short arc discharge) when operating with air-fuel mixture ratio in the region of 20:1 or E.G.R. diluted mixtures.

Other systems use a series of several short discharges generated from C.D.I. systems. Again they yield high system complexity which renders them impractical for commercial use in engines.

Another system covers Plasma Jet Ignition (P.J.I.). This system has undergone considerable investigation during the 1970's and has been shown to be very effective in promoting leaner engine combustion. However, this system is undesirable from the standpoint of electrode erosion.

Another system covers Hard Discharge Ignition (H.D.I.). This system shows high complexity and has not yet proved able to run with highly diluted mixtures.

SUMMARY

According to the present invention, a system for initiating and enhancing the combustion of air-fuel mixtures as above employs a Direct Current (D.C.) voltage to initiate the breakdown the spark plug gap and the electrical discharge, and a D.C. current to maintain the discharge for a selected amount of time.

An embodiment of the present invention provides an ignition system which, at first, initiates the combustion with a low impedance high voltage circuit that provides a high voltage rise during the breakdown phase and a high current during the arc discharge, then, enhances the combustion during the glow discharge, according to the engine operation, using a controllable lower voltage source.

This Direct Current Ignition (D.C.I.) system uses a high voltage D.C. source to supply the spark energy to each spark plug, a high voltage capacitance and a high voltage switching device to control the spark discharge.

The high voltage capacitance in the high voltage path stores the breakdown and arc discharge energy. The use of D.C. sources enables the storage of the energy in small size low impedance low cost capacitances beside the application, giving a fast rise time.

The use of high voltage switches makes possible the use of D.C. energy for the discharge without any additional circuitry for converting the energy (like step-up transformers in C.D.I. systems) or directing the energy (like high voltage distributors), yielding in more efficient energy coupling.

The selection of the capacitor size in the high voltage branch permits the adjustment of the breakdown and arc discharge depending on the application.

The glow discharge (current generated by the high voltage source once the high voltage capacitor is discharged) is determined by the internal resistance of the high voltage circuitry.

Preferably the Direct Current ignition (D.C.I.) system according to this invention uses two high voltage D.C. sources to supply the spark energy to each spark plug and two high voltage switching devices to control the spark discharge.

The higher voltage supply is only used for storing the breakdown and arc energy in the high voltage capacitance. The lower voltage source is used to generate the current of the glow discharge so providing good energy coupling.

The control of the switches in the lower voltage branch enables the adjustment of the glow discharge duration, and hence, the total discharge energy in real time depending on the engine demand and conditions.

BRIEF DESCRIPTION OF THE DRAWINGS

The invention is described in greater detail hereinafter relative to non-limitative embodiments and the attached drawings, in which.

DESCRIPTION OF THE PREFERRED EMBODIMENT

Figure 1:
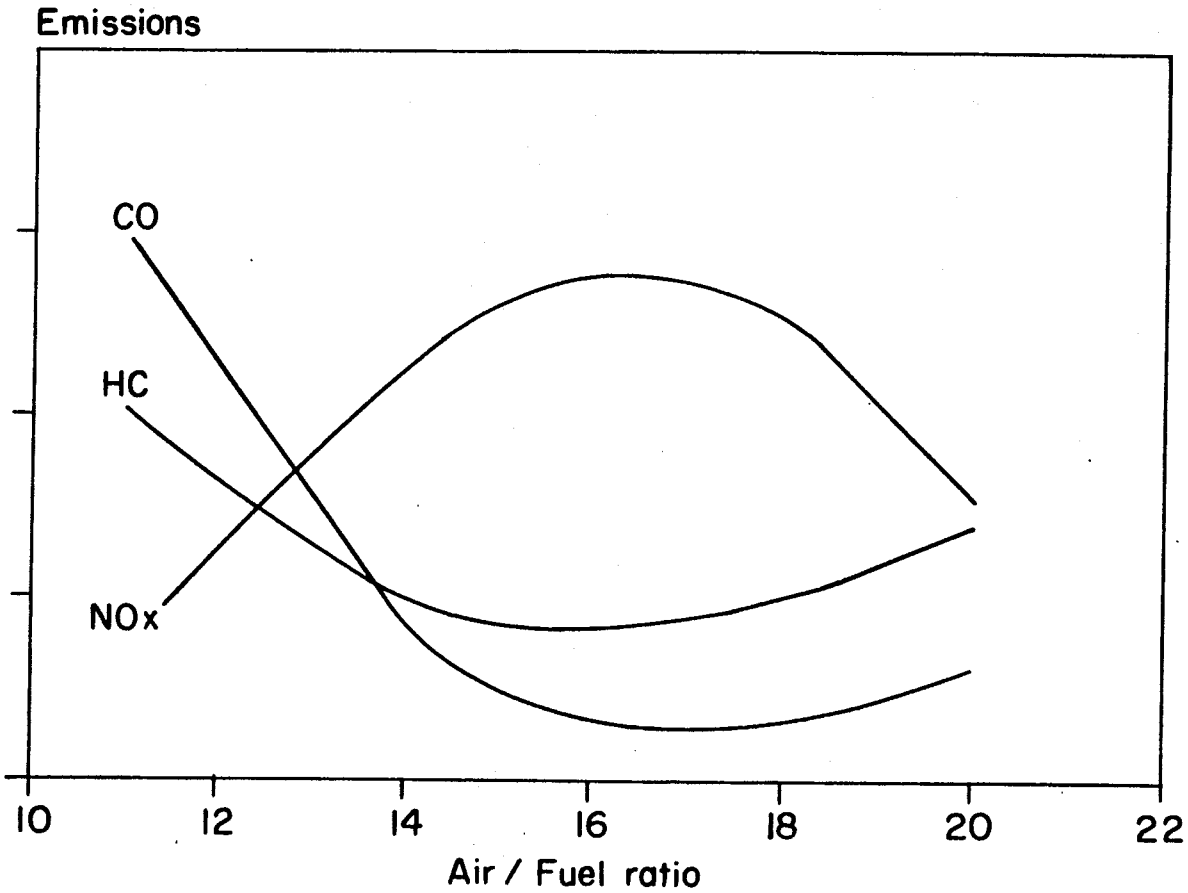
FIG. 1 shows exhaust emissions from spark ignition engines with respect to the excess air factor.
Figure 2:
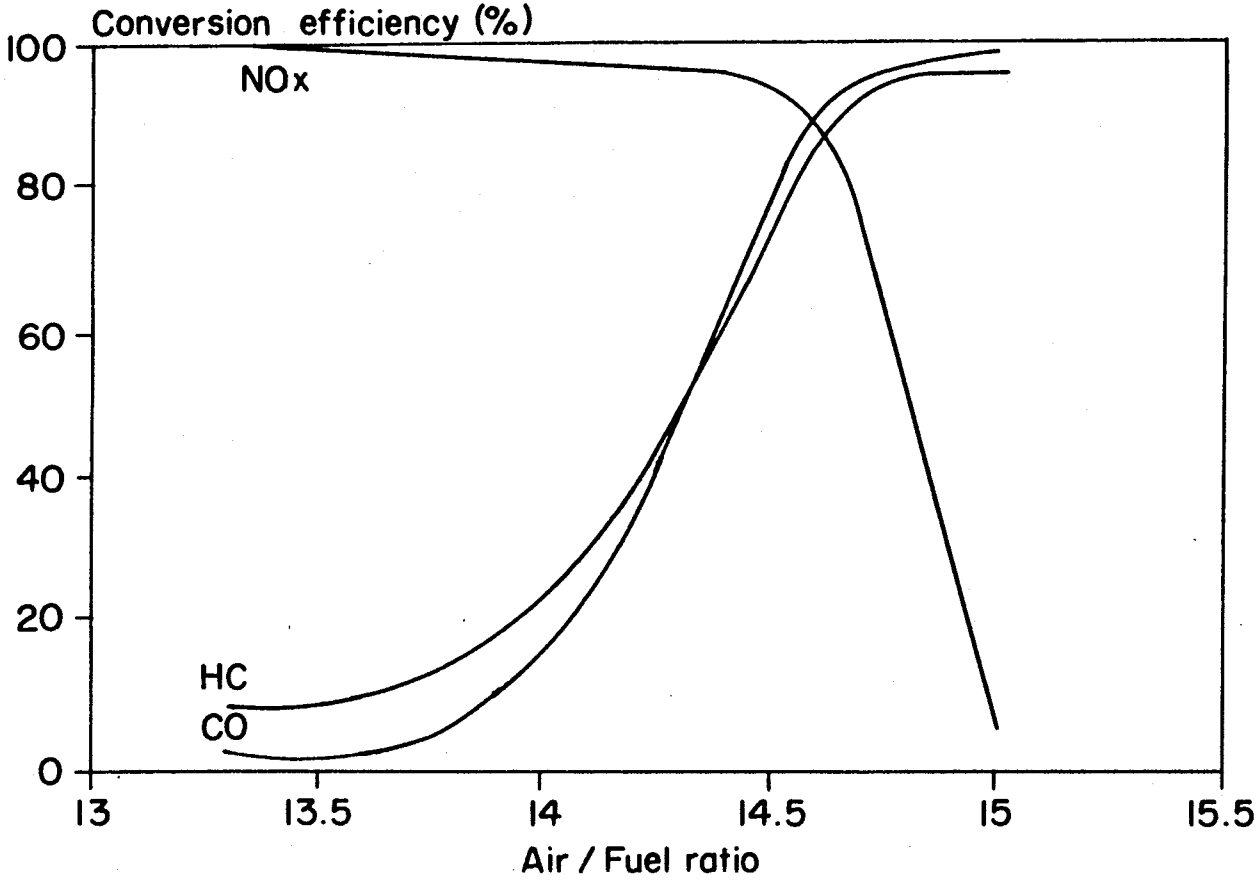
FIG. 2 shows a typical conversion efficiency of three-way catalytic converters.
Figure 3:
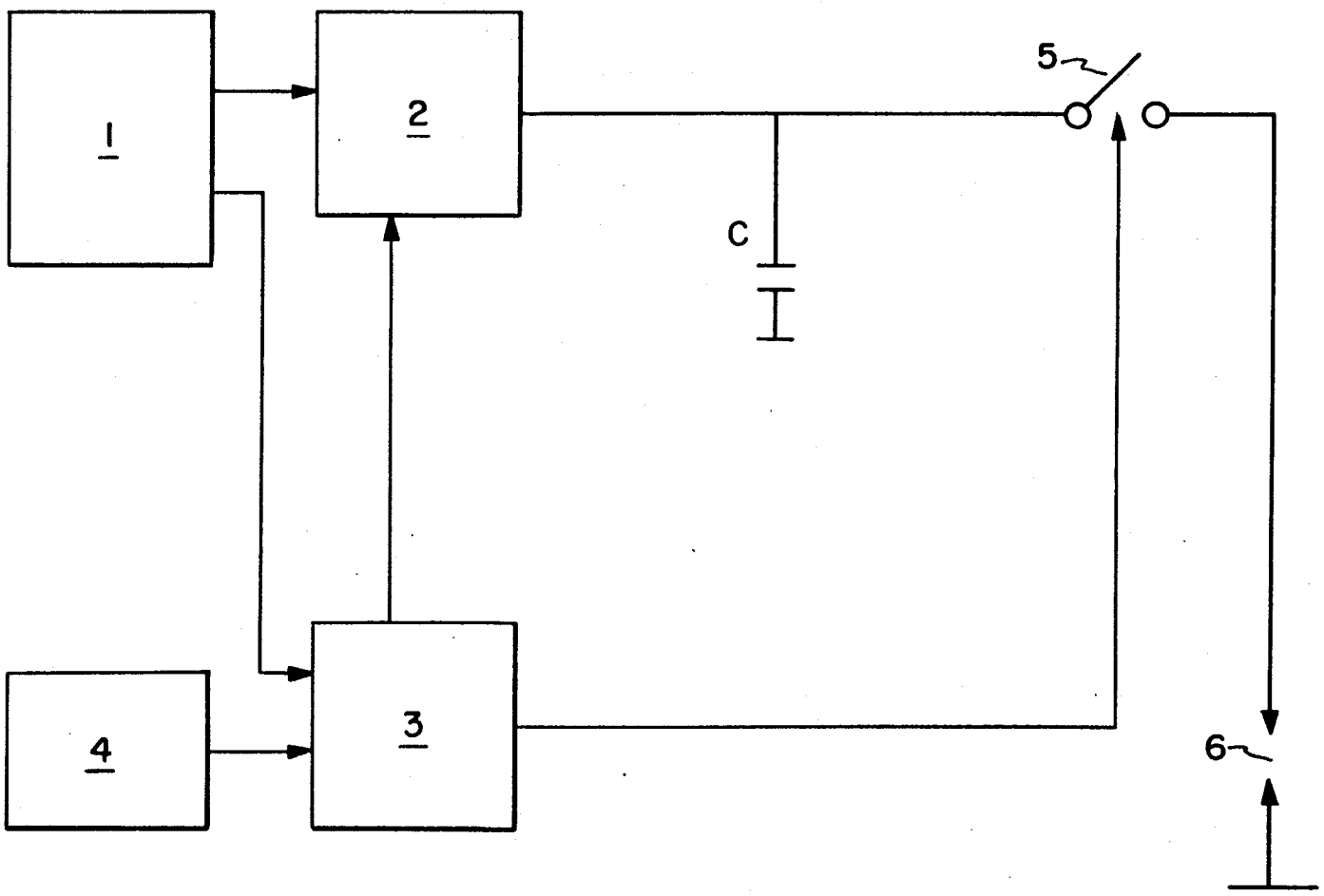
FIG. 3 shows a block diagram of a basic direct current ignition system according to this invention applied to a single spark plug.

FIG. 3 shows a block diagram of a basic direct current ignition system according to this invention applied to a single spark plug. This system comprises a source of high voltage d.c. energy 2 which is supplied by battery 1. The output of source 2 is connected via high voltage switch 5 to sparking gap 6. The output is also connected via capacitor C to ground.

The system is controlled by controller 3 which has as inputs signals from sensors 4 which indicate the engine condition and position. From this information, controller 3 determines the point at which a spark is required in sparking gap 6.

During the time a spark is not required, switch 5 is open and high voltage source 2 charges capacitor C up to the voltage required to breakdown the sparking gap 6, typically 30 kV. When a spark is required, high voltage switch 5 is closed and capacitor C discharges through the spark gap 6, generating a spark as required.

Figure 4:
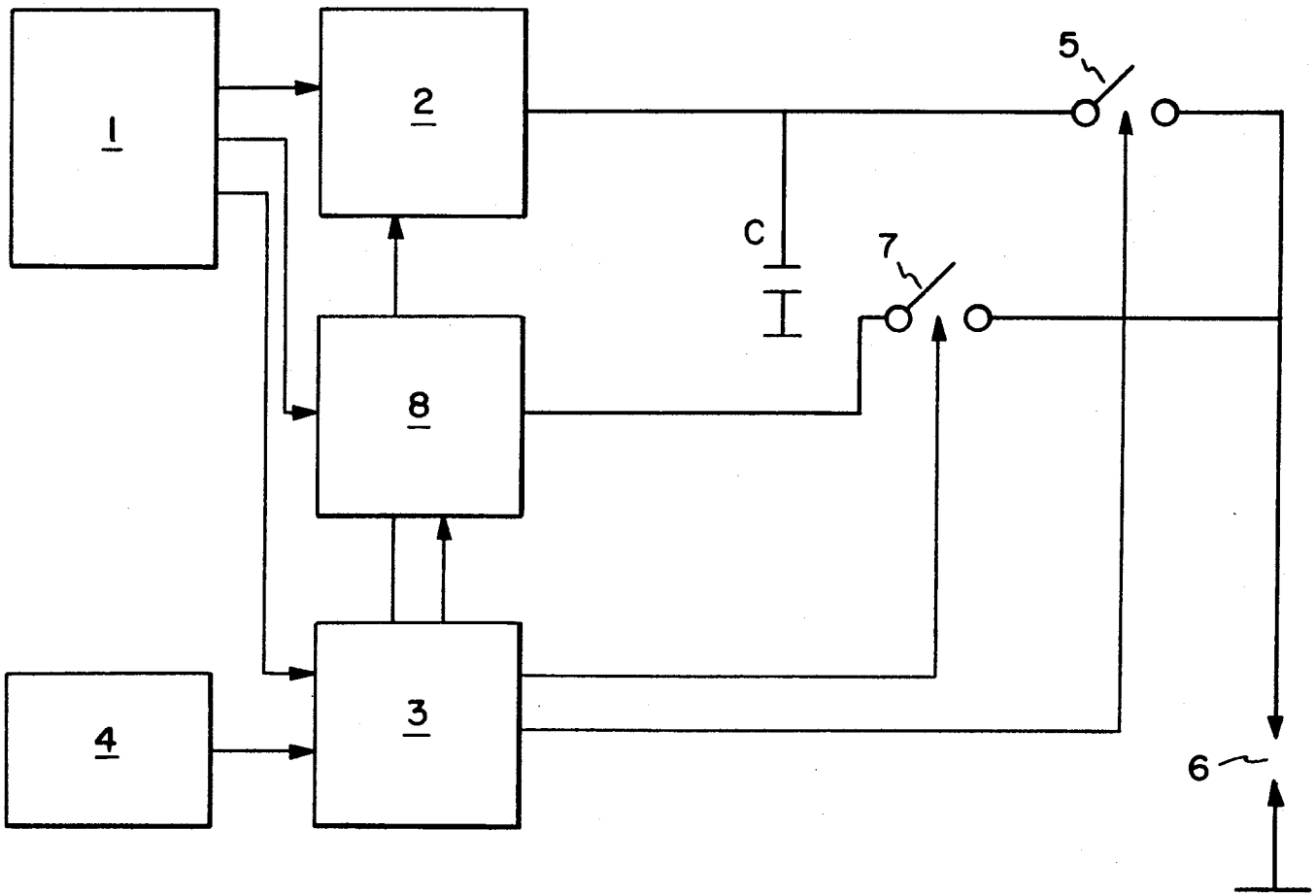
FIG. 4 shows a block diagram of another direct current ignition system according to this invention also applied to a single spark plug.

FIG. 4 shows a block diagram of another direct current ignition system according to this invention. The system has all the components of the system shown in FIG. 3, but in addition has a further source of high voltage d.c. energy 8 and a further high voltage switch 7. The further source of high voltage 8 supplies a voltage necessary to maintain the spark in the spark gap once it has been initiated, typically 3 kV.

In this system, controller 3 closes switch 5 at the time a spark is required and capacitor C discharges as described above. Switch 7 is then closed to supply energy from high voltage source 8 which maintains the spark for a selected period of time. This action is particularly useful in lean burn engines as described above.

Figure 5:
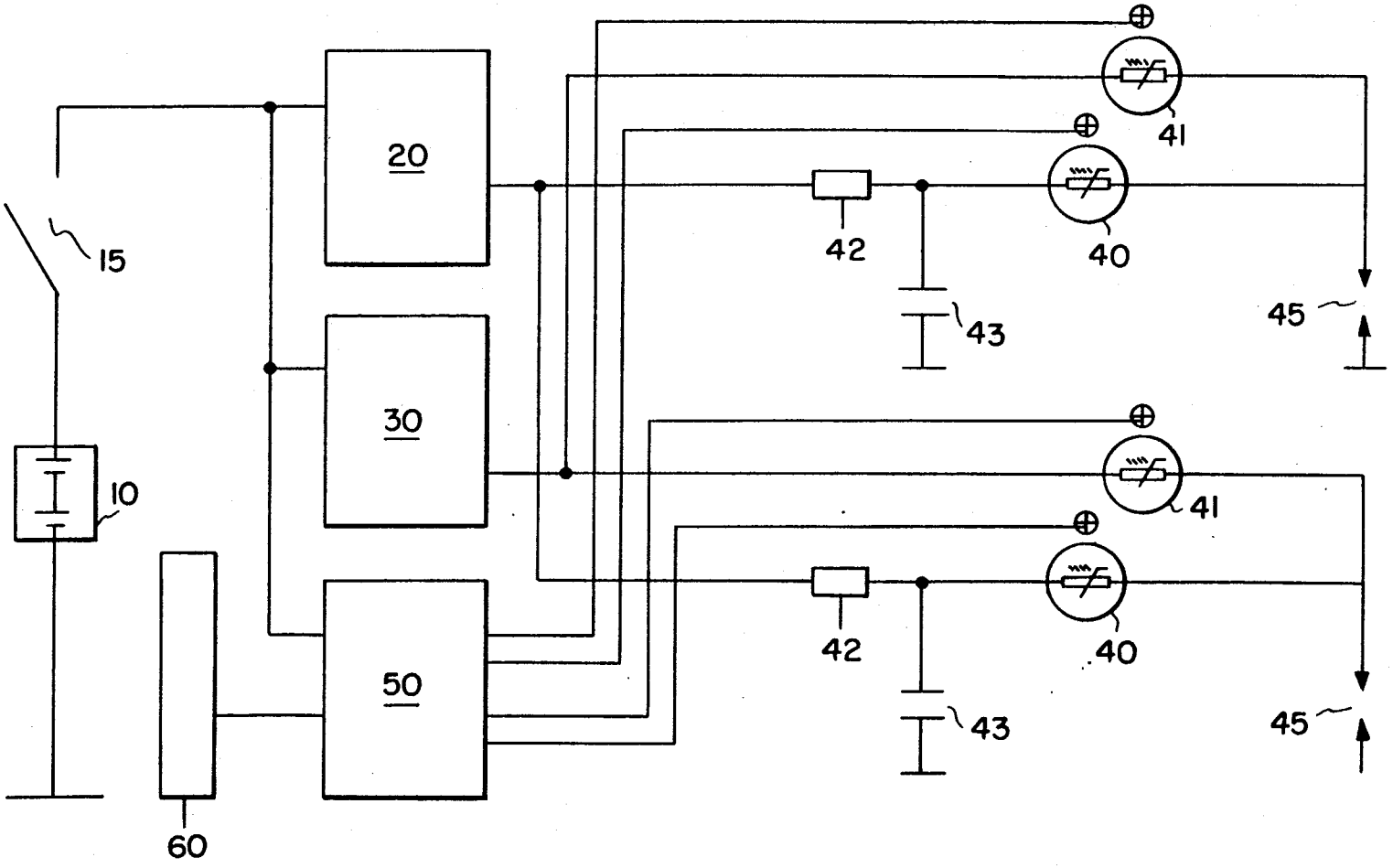
FIG. 5 shows a system based on the embodiment shown in FIG. 4 extended to include a plurality of spark plugs.

More detailed description of a preferred embodiment of the present invention will be made with reference to FIG. 5, which shows a system based on that shown in FIG. 4, but extended to include a plurality of spark plugs.

In this embodiment, a source of 12 volts D.C., such as a conventional automobile battery 10 provides D.C. power to two power conditioning units 20, 30 and the control circuit 50 through the ignition key switch 15.

Power conditioning units 20, 30 each consist of a D.C. to D.C. convertor arrangement in the form of a voltage transformer that charges capacitors at a high voltage in order to store enough energy to supply a plurality of spark plugs. A preferred type consists of a blocking oscillator that charges an energy store capacitor at a fixed and regulated output voltage.

Power conditioning unit 20 provides a high voltage in the order of 30 kV, as the proper voltage to initiate the spark plug gap breakdown and arc discharge. Power conditioning unit 30 provides a high voltage in the order of 3 kV to maintain the spark in the glow discharge mode.

Small capacitors 43 are used in the higher voltage path for storing the breakdown and arc discharge energy of each spark plug. A typical value for these capacitors is in the order of 100 pF. High voltage foil capacitors are preferred. These capacitors are advantageously placed as near as possible to the corresponding spark plug.

A high voltage switch 40 controls the discharge of the capacitor coupled to each spark plug 45 in the higher voltage path. When the switch is open, the capacitor is pre-charged to a voltage of 30 kV through the voltage power conditioning unit 20. At the time the switch closes, the capacitor is fully charged and full discharge is made through the spark plug, initiating the breakdown and arc discharge.

Resistances 42 are placed in series in the higher voltage rail leads in multi-cylinder applications. They prevent interference between the different spark plug circuits, hence enabling the charging of other capacitors while one is being discharged in a spark plug gap.

In the lower voltage path, a second high voltage switch 41 controls the lower voltage energy transferred to the spark plug. This energy is transferred at the end of the arc discharge, when the higher voltage capacitor is discharged down to a voltage of 3 kV, in order to maintain the spark in the glow discharge mode. The glow discharge is then maintained for a selected amount of time.

Preferred high voltage switches consist of bulk photoconductive switches. This type of switch is a semiconductor device which comprises photosensitive material and a light source. The resistance of the photosensitive material varies depending on the intensity of light falling on it from its light source. A typical device of this type uses, as the photoconductive layer, a sintered mixture comprising, by weight, 63 to 74% cadmium, 12 to 24% selenium, 8 to 14% sulphur, 0.1 to 1% chorine and 0.005 to 0.1% copper; and as the light source, one or more light emitting diodes (L.E.D.) which are used to illuminate the layer. All the components are integrated into a single switch package.

The photoconductive material composition may be adjusted depending whether the switch is being used in the higher or lower voltage path. For use in the higher voltage path, the material composition and treatment are preferably such that the "off" resistance (non-conductive mode, light turned off) reaches 400–30,000 MegOhms, the "on" resistance (conducting mode, light turned on) falls below 50 kiloOhms and the switching time falls below 10 μS. In the lower voltage path, it is important that the "on" resistance falls below 20 kiloOhms.

Engine ignition control, and hence, high voltage switch control, is assumed by a controller 50 that senses engine operation through various sensors 60 and activates the different high voltage switching accordingly via their associated light sources.

Figure 6B:
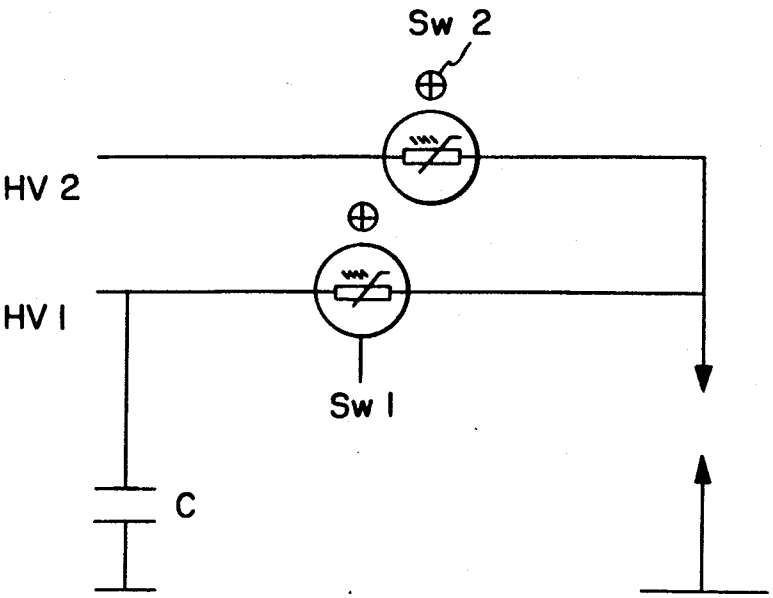
FIG. 6A/B show a typical timing diagram for the embodiment of FIG. 5.
Figure 6A:
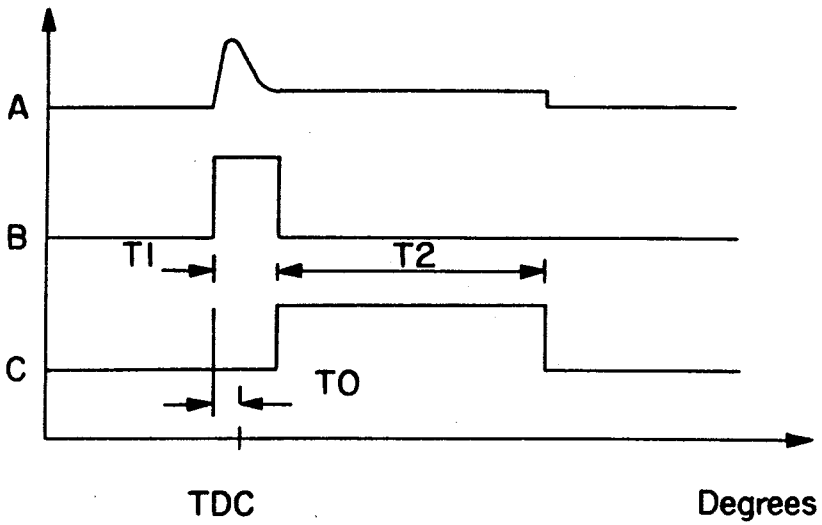

Typical timing for a Direct Current Ignition system according to this embodiment is shown in FIG. 6. FIG. 6A shows the spark potential profile, 6B shows the operation of switch Sw1 and 6C shows Sw2. This FIGURE shows the activation of the switch Sw1 in the higher voltage rail HV1 a given time (T0) before engine piston Top Dead Centre (T.D.C.) position. The switch is activated for a given time (T1) that corresponds to the discharge of the capacitor C and the arc discharge in the spark plug gap. At the end of this period, this switch is disabled and the switch Sw2 in the lower high voltage rail HV2 is activated for a selected amount of time (T2) to maintain the glow discharge.

T0, the ignition advance, is mainly defined by the engine design, the engine speed, the engine load, the inlet air pressure and the air/fuel ratio. It typically varies from 5 to 20 crankshaft angle degrees.

T1, the duration of the breakdown and arc discharge is a function of the size of the capacitor C. A typical value is around 50 $\mu$S.

T2, the glow discharge, is determined by the Direct Current Ignition controller. It may be varied from 1 to 20 mS depending on the air/fuel mixture.

Figure 7B:
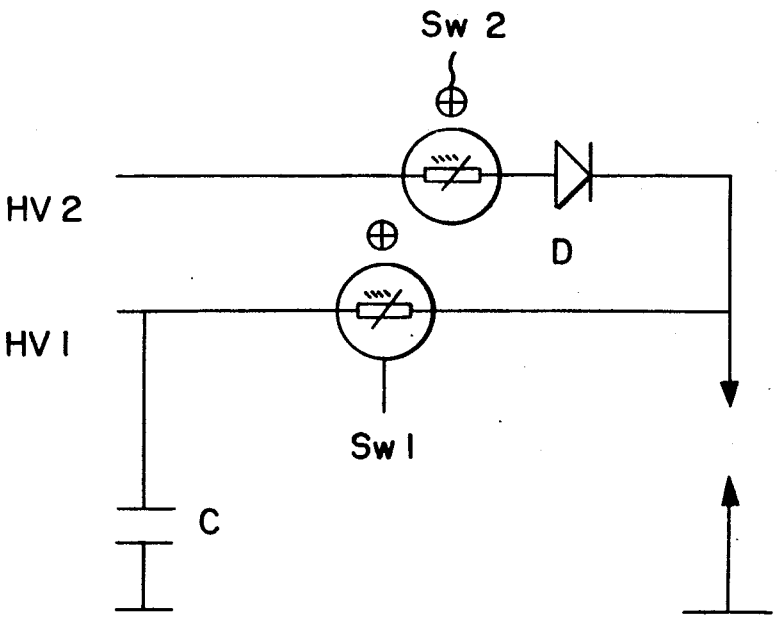
FIG. 7A/B show a variation in the circuitry of FIG. 5 and an associated timing diagram.
Figure 7A:
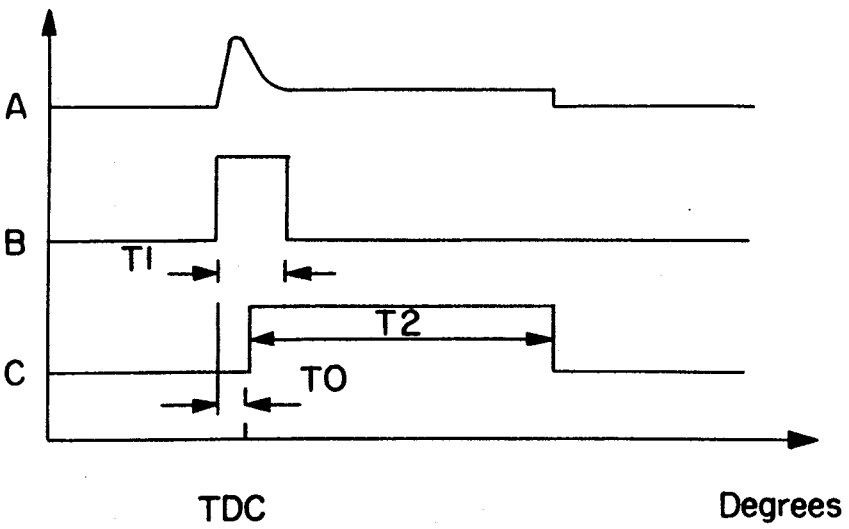

FIG. 7 shows an improvement in the high voltage ignition circuitry that relaxes the constraints on the timing signals for the switches. Here also, FIG. 7A shows the spark potential profile, 7B shows the operation of which Sw1 and 7C shows the operation of switch Sw2. The circuitry uses a diode D in series with the lower high voltage rail Hv2 that enables the two switches control signals to overlap, and so it assures a perfect transition between arc and glow discharge. The diode should be able to withstand a reverse voltage of 30 kV and support the direct current of the glow discharge.

Figure 8:
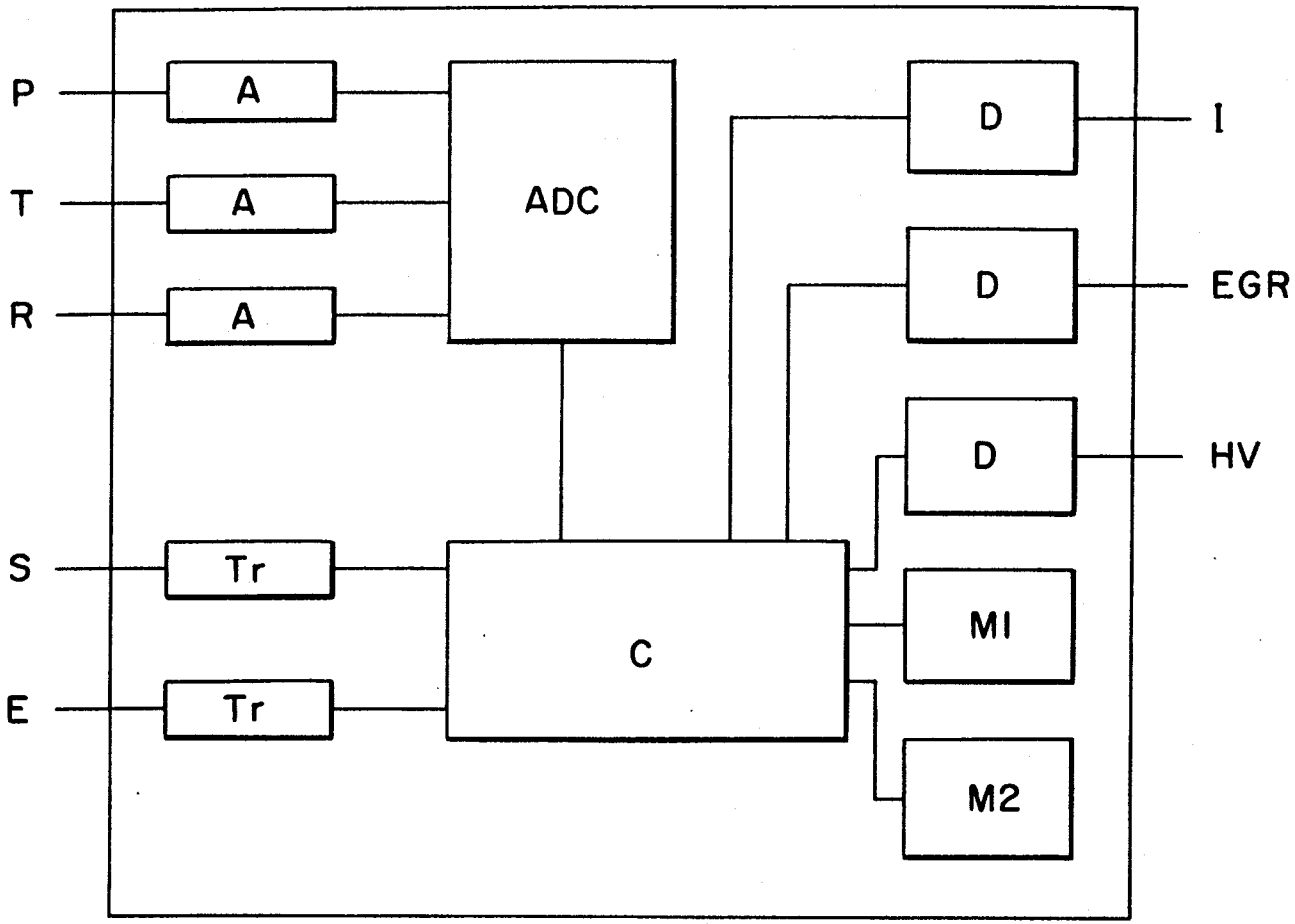
FIG. 8 shows a block diagram of a direct current ignition controller according to this invention.

FIG. 8 illustrates a block diagram of a Direct Current Ignition controller according to this invention.

This controller operates using signals generated by engine sensors indicating engine condition parameters such as intake air pressure P, intake air temperature T, engine position E and engine speed. These are input to microcontroller C via amplifiers A and an analog-to-digital converter or a trigger Tr. The microcontroller C uses these inputs together with an ignition timing map M2 to determine the correct engine ignition point in a similar manner to conventional advanced ignition controllers.

Using this data, the microcontroller C activates the high voltage switches associated with the respective cylinders via the HV output driven by driver D.

The D.C.I. controller differs from conventional controllers in that it also controls the ignition duration in accordance with the engine operating conditions. For this purpose, the controller has a further input R indicating the fuel/air ratio and determines from an ignition duration map M1 the correct spark duration to apply to the mixture. This duration is controlled via the high voltage switches as described above.

When the engine is running with a lean or diluted fuel mixture, the controller may also adjust the air/fuel ratio by way of an output I in accordance with the engine speed. It may also adjust the E.G.R. valve when using exhaust gas recirculation. This makes it possible, for example, to use a diluted mixture at low engine speeds and to use a mixture at the stoichiometric ratio at high speeds, and thus giving a good overall emission performance.

The energy transferred through the higher voltage path is given by the equation:

$$W = n \cdot \eta \cdot C \cdot U^2/2 \text{ where}$$

n is the number of sparks per second, $\eta$ is an efficiency factor for the charging and discharging cycle of the capacitor and is usually less than 50%, C is the value of the capacitor, and U is the value of the higher voltage.

For an engine running at 6000 R.P.M. (engine revolutions per minute), the energy transferred through the higher voltage path is in the order of 5 Watts per spark plug, and this defines the output rating of the higher voltage power conditioning unit 20.

Resistors 42 in series with each high voltage capacitor are such that they enable the capacitor to recharge within the interval between two sparks on a given cylinder. At 6000 R.P.M., on a four stroke engine, a spark occurs every 20 mS, which allows typically 10 mS for the capacitor to recharge. Maximum resistor value is so defined by:

$$R = t \cdot a \cdot \eta / C \text{ where}$$

a is an empirically defined constant (usually 5)

A typical value of R is 100 MOHms.

The lower voltage path delivers the necessary energy to maintain the glow discharge. Lower voltage power conditioning unit 30 should limit the current circulating in the spark to about 20 mA. This yields an energy of about 20 mJ per mS, and so, up to 400 mJ for a peak spark duration of 200 mS.

This amount of energy is only required when the engine is running with a highly diluted or lean mixture and at low speeds. In these conditions, the power rating of the lower voltage power conditioning unit does not exceed 5 Watts per spark plug.

Figure 9:
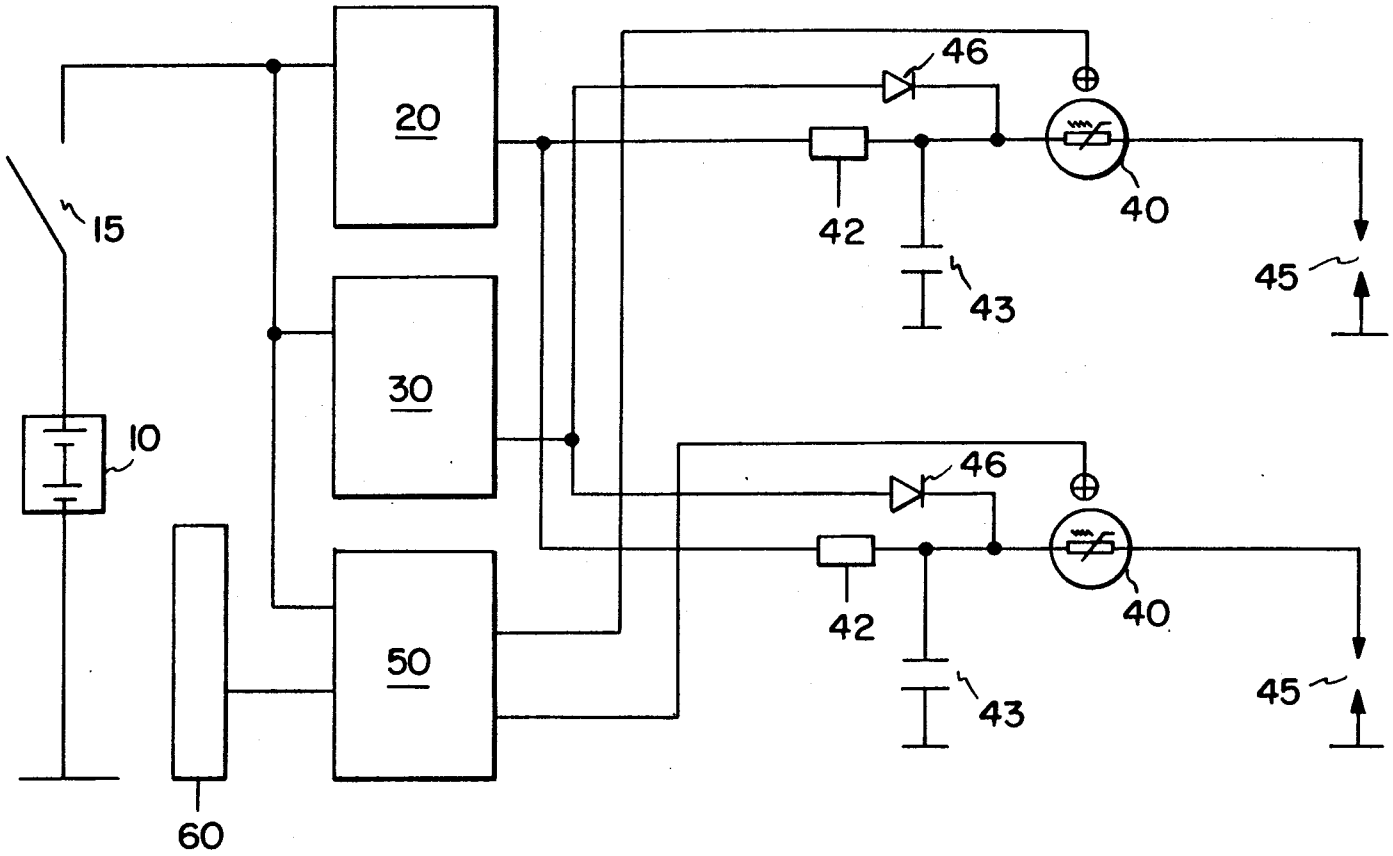
FIG. 9 shows a further embodiment of this invention.

FIG. 9 illustrates an embodiment of this invention in which only one switch is used to control each spark plug, as in the arrangement of FIG. 8 but which has two high voltage sources as in the arrangement of FIG. 4. Many components are the same as those needed in the embodiment illustrated in FIG. 5 and the same reference numerals are used to indicate the same components. As before, power conditioning unit 20 provides a high voltage in the order of 30 kV and power conditioning unit 30 provides a high voltage in the order of 3 kV. The higher voltage rail is connected to charge capacitors 43 via resistors 42.

In this embodiment, the lower voltage rail from power conditioning unit 30 is connected via diodes 46, together with the higher voltage rail to one electrode of switches 40. The other electrode of each switch 40 is connected to a respective spark gap 45. Thus in this embodiment there is only one BPSD associated with each spark gap.

Control circuitry 50 again receives as inputs signals indicative of various engine running parameters and is operative to activate the light sources associated with the switches 40 at the appropriate times to provide high voltage pulses to the spark gaps 45.

At the moment when a switch 40 is switched on the associated capacitor 43 is fully charged. As in the previous embodiment the capacitor discharges across the spark gap so breaking it down and causing a spark. When the capacitor 43 has discharged sufficiently that the potential in the higher voltage rail falls below the voltage generated by power conditioning unit 30, diode 46 allows current to flow from power conditioning unit 30 to maintain the spark during the glow discharge.

This continues until switch 40 is switched off by control circuitry 50.

Thus a spark with a potential profile similar to that illustrated in FIG. 6 may be produced by using only a single BPSD associated with each spark gap.

In the embodiments described above and illustrated in FIGS. 5 and 9, two high voltage d.c. supplies are used, one typically generating 30 kV and the other 3 kV. The higher voltage supply typically must be able to supply a current of 1 mA while the lower voltage supply typically must be able to supply 10 mA. It is possible to use a single supply which generates both the higher voltage and the higher current, but such a unit tends to be physically large and potentially dangerous.

Thus in summary the fundamental components of this invention are a source of d.c. power, capacitance in a high voltage path to provide the breakdown voltage and high voltage switches. In some arrangements the capacitance may be provided by the spark leads themselves.

What is claimed is:

1. An ignition system for an internal combustion engine, comprising:

a source of high voltage direct current energy including a D.C./D.C., converter, the output of which is of substantially the same potential as that to be applied to the sparking gap, a means for storing the energy generated by said source including one or more discrete high voltage capacitors, a high voltage switch arranged to release said stored energy to said sparking gap including a bulk photoconductive switch device, a further source of high voltage direct current energy, the output of which is of a substantially lower potential than that generated by the first mentioned source; and a further high voltage switch operative, after the initiation of the spark, to maintain the discharge in the sparking gap for a selected amount of time by transferring energy from the second source of high voltage to the sparking gap.

2. An ignition system according to claim 1 wherein the further voltage switch is a semiconductor switch.

3. An ignition system according to claim 2 wherein the semiconductor switch comprises a bulk photoconductive device.

4. An ignition system for an internal combustion engine, comprising:

a source of high voltage direct current energy, the output of which is of substantially the same potential as that to be applied to the sparking gap;

a means for storing the energy generated by said source;

a high voltage switch arranged to release said stored energy to said sparking gap;

a further source of high voltage direct current energy, the output of which is of a substantially lower potential than that generated by the first mentioned source, and is connected via a diode to said high voltage switch, wherein the high voltage switch is operative initially to release said stored energy to the sparking gap and then to transfer energy from the further source of high voltage to the sparking gap in order to maintain the discharge in the sparking gap for a selected amount of time.

5. An ignition system according to claim 1 or 4 further comprising a controller which has as input signals from engine sensors and which is operative to determine in real time from said signals the selected amount of time for which the discharge is maintained and which controls the operation of the high voltage switch through which energy from the further source is transferred to the spark plug.

6. An ignition system according to claim 1 or 4 wherein the two high voltage sources are combined in single unit which provides both of the required high voltages.

* * * * *